US011376185B2

(12) United States Patent
Nash

(10) Patent No.: US 11,376,185 B2
(45) Date of Patent: Jul. 5, 2022

(54) MASSAGE APPARATUS AND METHOD OF USE

(71) Applicant: 3RD WHEEL PRODUCTIONS PTY LTD, Alderley (AU)

(72) Inventor: Paul Nash, Alderley (AU)

(73) Assignee: 3RD WHEEL PRODUCTIONS PTY LTD, Alderley (AU)

( * ) Notice: Subject to any disclaimer, the term of this patent is extended or adjusted under 35 U.S.C. 154(b) by 0 days.

(21) Appl. No.: 16/753,922

(22) PCT Filed: Oct. 6, 2017

(86) PCT No.: PCT/IB2017/056169

§ 371 (c)(1),
(2) Date: Apr. 6, 2020

(87) PCT Pub. No.: WO2019/069118

PCT Pub. Date: Apr. 11, 2019

(65) Prior Publication Data

US 2020/0368101 A1 Nov. 26, 2020

(51) Int. Cl.
*A61H 15/00* (2006.01)

(52) U.S. Cl.
CPC ..... *A61H 15/00* (2013.01); *A61H 2015/0014* (2013.01); *A61H 2015/0057* (2013.01); *A61H 2201/0107* (2013.01); *A61H 2201/1253* (2013.01); *A61H 2201/1671* (2013.01); *A61H 2201/1685* (2013.01);

(Continued)

(58) Field of Classification Search
CPC ..... A61H 15/00; A61H 15/0092; A61H 2015/0014; A61H 2015/0057; F16B 7/06; Y10T 403/29; Y10T 403/291; Y10T 403/293; Y10T 403/295
See application file for complete search history.

(56) References Cited

U.S. PATENT DOCUMENTS 1,400,547 A * 12/1921 Holmstrom ..... A61H 15/0092 601/125
2,091,131 A * 8/1937 Cone ..... A61H 15/0092 601/119

(Continued)

OTHER PUBLICATIONS

International Search Report for International Application No. PCT/IB2017/056169, dated Dec. 12, 2017, 4 pages.

(Continued)

*Primary Examiner* — Justine R Yu
*Assistant Examiner* — Christopher E Miller
(74) *Attorney, Agent, or Firm* — Armstrong Teasdale LLP

(57) ABSTRACT

A massage apparatus and a method of its use for massage of the human body are provided, the massage apparatus including a frame supporting opposingly-located first and second massage tools mounted thereon to define between them a massage gap, wherein a body portion is receivable for massaging. The gap is adjustable while the apparatus is in use, for the massage tools in use to exert therapeutically effective force substantially continuously on a massage-receiving body portion received in the gap. The massage tools are interchangeable with massage tools of other shapes designed to provide different therapeutic effects. The frame is open- and closeable to accommodate limbs of different sizes.

13 Claims, 3 Drawing Sheets

(52) U.S. Cl.
CPC .. *A61H 2201/1692* (2013.01); *A61H 2205/04* (2013.01); *A61H 2205/06* (2013.01); *A61H 2205/083* (2013.01); *A61H 2205/088* (2013.01); *A61H 2205/10* (2013.01)

(56) References Cited

U.S. PATENT DOCUMENTS 2,184,358 A * 12/1939 Moore ..... F16B 7/149 285/302
2,219,138 A * 10/1940 Morrison ..... A61H 15/0078 601/125
2,223,263 A * 11/1940 Michaelson ..... A61H 15/00 601/128
2,230,890 A * 2/1941 McClenathen ..... A61H 15/00 601/122
2,310,804 A * 2/1943 Morrison ..... A61H 15/0092 601/125
2,380,632 A * 7/1945 Cousino ..... F16B 7/105 403/107
2,382,291 A * 8/1945 Carlberg ..... B25G 1/043 403/107
2,618,496 A * 11/1952 Johnson ..... E04G 5/02 403/290
2,970,388 A * 2/1961 Yonkers ..... G09B 23/26 434/277
3,088,458 A * 5/1963 Stewart ..... A61H 15/00 601/122
3,583,396 A * 6/1971 Landis ..... A61H 15/0092 601/125
3,638,939 A * 2/1972 Langley ..... A61H 1/0244 482/132
3,645,256 A * 2/1972 Morrison ..... A61H 15/00 601/122
3,746,336 A * 7/1973 Tanimoto ..... A63B 21/0004 482/46
3,759,250 A * 9/1973 Salata ..... A61H 15/00 601/122
3,887,228 A * 6/1975 Ingerson ..... A61G 5/1083 297/39
4,553,770 A * 11/1985 Lyman ..... A61G 5/1062 280/304.1
4,555,124 A * 11/1985 Millington ..... B62B 5/002 280/304.1
5,195,510 A * 3/1993 Svacina ..... A61H 7/003 601/135
5,411,470 A * 5/1995 Liptak ..... A61H 15/00 601/118
5,488,755 A * 2/1996 Chang ..... A63B 23/16 16/430
5,519,918 A * 5/1996 Chang ..... A63B 23/16 16/430
5,643,182 A * 7/1997 Engel ..... A61H 15/0092 601/119
5,730,708 A 3/1998 Spratt
5,792,081 A * 8/1998 Cross ..... A61H 15/0092 601/123
5,887,314 A * 3/1999 Jordan, Jr. ..... A47L 13/12 15/144.3
5,947,666 A * 9/1999 Huang ..... B60P 7/15 410/143
6,033,372 A * 3/2000 Tarbet ..... A61H 15/0092 601/123
6,129,650 A * 10/2000 Wedge, Jr. ..... A63B 71/0009 482/139
6,182,313 B1 * 2/2001 Eschenbach ..... A47G 9/1009 5/639
6,419,253 B1 * 7/2002 Mascari ..... A61G 5/1059 280/250.1
6,814,645 B2 * 11/2004 Kuk ..... A63B 19/00 446/236
8,234,755 B1 * 8/2012 Brand ..... B25G 1/04 16/427
9,266,478 B2 * 2/2016 Patel ..... B60R 9/058
9,539,168 B2 * 1/2017 Johnston ..... A61H 15/0092
9,649,246 B1 * 5/2017 Johnson ..... F16B 7/10
10,327,981 B1 * 6/2019 Ayotte ..... A61H 15/0092
2004/0267174 A1 * 12/2004 Meisch ..... A61H 7/005 601/133
2005/0159688 A1 7/2005 Sakamoto et al.
2005/0233839 A1 * 10/2005 Adams ..... A63B 60/00 473/513
2007/0287604 A1 * 12/2007 Lee ..... A61H 1/0244 482/92
2009/0169291 A1 * 7/2009 Hartlmeier ..... F16B 7/06 403/46
2010/0274165 A1 10/2010 Evans
2011/0137218 A1 6/2011 Collins
2011/0269607 A1 * 11/2011 Choi ..... A63B 21/00072 482/126
2011/0301000 A1 * 12/2011 Pullen ..... A61H 1/0292 482/109
2012/0203151 A1 8/2012 Kleiman
2013/0023807 A1 * 1/2013 Hennessey ..... A61H 7/003 601/119
2013/0123078 A1 5/2013 Marji
2013/0190664 A1 * 7/2013 Johnson ..... A61H 15/0092 601/129
2013/0289454 A1 * 10/2013 Wang ..... A61H 15/00 601/132
2014/0228722 A1 8/2014 Nelson
2016/0022529 A1 * 1/2016 Abdo ..... A61H 15/0092 601/119
2016/0151235 A1 * 6/2016 Yu ..... A61H 7/007 601/135
2016/0279010 A1 * 9/2016 Lutz ..... A61H 1/024
2016/0296415 A1 10/2016 Cross
2017/0056284 A1 * 3/2017 Kramer ..... A61H 15/0092
2017/0120100 A1 * 5/2017 Smith ..... A63B 21/026
2017/0136286 A1 * 5/2017 Lewis ..... A63B 21/00069
2017/0258671 A1 * 9/2017 Turner ..... A61H 7/008
2018/0161234 A1 * 6/2018 Dominee ..... A61H 15/0092
2018/0280229 A1 * 10/2018 Cross ..... A61H 7/003
2019/0099323 A1 * 4/2019 Nelson ..... A61H 15/0092
2019/0274915 A1 * 9/2019 Cross ..... A61H 15/0092
2020/0246214 A1 * 8/2020 Nelson ..... A61H 1/00

OTHER PUBLICATIONS

Written Opinion of the International Searching Authority for International Application No. PCT/IB2017/056169, dated Dec. 12, 2017, 5 pages.
International Preliminary Report on Patentability for International Application No. PCT/IB2017/056169, dated Jan. 13, 2020, 6 pages.

* cited by examiner

MASSAGE APPARATUS AND METHOD OF USE

CROSS REFERENCE TO RELATED APPLICATIONS

This patent application is a National Stage Entry of PCT/IB2017/056169, filed on Oct. 6, 2017, the disclosure of which is hereby incorporated by reference herein in its entirety as part of the present application.

FIELD OF THE DISCLOSURE

This disclosure relates to massage apparatus and a method of its use for massage of the human body.

BACKGROUND

A significant body of prior art exists in relation to devices and apparatus for massaging limbs and areas of the human body. U.S. Pat. No. 5,730,708 to Sprott discloses apparatus having splayed bars hingedly connected and having a massage pad on each. The pads are fixed to the bar against rotation and lateral movement and are applied to provide a rubbing or kneading action. They are demountable for cleaning or replacement.

US Patent Application Publication 2011/0137218 discloses massage apparatus having a pair of opposing rollers mounted on opposed respective sprung arms that extend upwardly from a base plate to define a massage gap between them. The constantly tensioned sprung arms impart force to the body portion received into the gap. Separate adjustment means adjust the width of the gap when the gap is not occupied or can be used to exert increased force once a body portion is operatively located within it.

US Patent Application Publication 2014/0228722 similarly discloses massage apparatus having opposing sets of rollers mounted on opposed respective spring-biased arms that are brought either side against a limb to be massaged. In the case of a self-administered massage of the back of the thigh while in a sitting position, the user is obliged to push generally upwardly with their one arm, suffering the inconvenience of the position risking trauma to other muscle groups in the process.

The above examples are of apparatus with a limited range of implementation and that rely for success on the physical strength of the person administering the massage.

BRIEF DESCRIPTION

According to a first aspect, there is provided a massage apparatus including:

a. An openable and closeable frame supporting oppositely-located first and second massage tools mounted thereon to define between them a massage gap, wherein a body portion is receivable for massaging, and b. Gap adjusting means whereby the gap is adjustable while the apparatus is in use, for said massage tools in use to exert therapeutically effective force substantially continuously on a massage-receiving body portion received in the gap.

The magnitude of the force that the tool exerts on the body portion in the gap is independent of force applied by a human tool user, due to the gap being adjustable during use by such user.

In a one embodiment, the gap is adjustable while therapeutic force is being applied to the body portion of a massage receiver.

In a further embodiment, the gap and the frame are located in different planes.

The first massage tool may include a roller. The roller desirably has a pliant outer surface.

The second massage tool may be configured to provide a predetermined massage effect. The tool may be stationary or moveable in relation to the frame. In an embodiment, the tool is rotatable in relation to the frame to apply rolling pressure to the body portion in the gap.

In a further embodiment, the frame has a pair of crossbars defining opposite frame sides, to each of which is mounted one of the massage tools, and a side element extending between the crossbars, the side element being adjustable in length for causing adjustment of the gap.

In a still further embodiment, the frame is separable into first and second subassemblies, each bearing one of said tools, said subassemblies being detachably connected by said gap adjusting means.

Each subassembly may include a pair of side elements linked by a crossbar and mounting means for said respective tools.

The second massage tool may be mounted to a structure mounted to the side elements.

In an embodiment, the second massage tool is selectable from a set of two or more removably mountable and interchangeable tools.

In a further embodiment, the set of second tools may include a tool that, in relation to the frame, is fixable in a desired stationary orientation, or is rotatably mountable.

In a still further embodiment, the gap adjusting means includes connector means operable for connecting and separating the subassemblies.

The connector means, by acting on the pairs of side elements, may connect a side element from one subassembly to a side element of the other.

In an embodiment, the side elements include a screw-threaded bar, engageable with the connector means of the adjusting means. The connector means includes a complementally threaded tube having opposite ends configured respectively to receive one of the side elements.

In a further embodiment, the connector means includes a reinforcing bar connector mechanism. The mechanism may include co-operating screw-threaded formations.

In a yet further embodiment, the adjusting means includes locking means for locking the connector means against uncontrolled release of at least one of the side elements.

The locking means may be engageable to prevent relative rotation between the connector means and said at least one frame element in a gap-widening direction. In an embodiment, the locking means includes a ratchet mechanism.

The crossbar of the first subassembly may be pivotally attached to the side elements of said subassembly.

In an embodiment of the invention, the first massage tool is mounted on a shaft connected to be parallel with the crossbar. In an embodiment, the shaft is spaced from the frame.

In a further embodiment, the shaft is mounted to depend from the crossbar.

The frame may include mounting means for mounting an axle for supporting the second tool in spaced relationship to the frame. The second tool may include stabilising means for engaging with the axle and with the frame.

The second massage tool, in an embodiment, may be supportively engaged with the crossbar when mounted.

According to a second aspect, there is provided an apparatus including:

a. First and second detachably connectable subassemblies bearing respective first and second massage tools, the first massage tool being for supporting a body portion to be massaged against the second tool, the second tool being adapted for providing a predetermined massage effect to a massage-receiving human body portion, and b. Connector means operable to:

i. connect the subassemblies together to define a closed frame, thereby to establish between the tools an adjustable gap, into which the body portion is receivable, and ii. control the gap size while massage therapy is being applied to the body portion.

The controlling of the gap, to provide therapeutically effective force to the body portion, is achieved independently of any action applied by the person using the tool either to give or receive the massage. They are required to cause the tool to traverse the skin of the recipient, but need not apply pressure of their own to the muscle in the body portion.

In one embodiment, the closed frame includes opposed first and second crossbars, connected to axially extensible side elements including said connector means.

The connector means may be independently operable.

In a further embodiment, the connector means are operable to cause elongation and shortening of the side elements, thereby causing controllable adjustment of the gap.

The connector means may be screw-threadedly attached to the subassemblies.

Each connector means may include releasable engagement means engageable with at least one of said subassemblies, engagement preventing rotation of the connector means in one predetermined direction relative to said at least one subassembly.

Still further, in an embodiment, the first tool is mounted to the first crossbar.

In such embodiment, the first tool may be rotatably mounted on a shaft spaced from the crossbar.

The first tool may include a roller. The roller may be provided to function as a support for an opposite side of the limb to the side receiving therapeutic or other predetermined form of massage. The roller may have a pliantly resilient surface.

In another embodiment, the second tool is mounted from the side elements. The second element may be mounted to a shaft connected to both side elements, the shaft being spaced from the second crossbar.

The shaft may be generally parallel with the second crossbar.

In a further embodiment, the second massage tool is adapted for being stationary in relation to the second crossbar the massage apparatus. In this embodiment, the second tool may be supported by the second crossbar.

The second tool may engage with the second crossbar to inhibit relative movement between them.

In a still further but alternative embodiment, the second tool is rotatably mounted on the shaft.

In a yet further embodiment, the gap and the frame are located in different planes.

In an embodiment, the apparatus includes a set of two or more removably mountable and interchangeable second massage tools having shapes adapted for providing respectively different massage effects.

According to a third aspect of the apparatus of this disclosure, there is provided a method of therapeutic massage including the steps of:

a. providing massage-giving apparatus comprising:

i. First and second detachably connectable subassemblies bearing respective first and second massage tools, in combination being capable of imparting a therapeutic massage effect to a body part of a massage recipient requiring massage; and ii. Connector means connectable between the subassemblies to form a frame defining a gap between the tools for receiving the body part for massage;

b. Operating the connector means to connect the subassemblies together to form said frame and define said gap between the tools;

c. Causing placement of the body part to be massaged in the gap; and d. Operating the connector means for adjusting the gap during massage-giving, for the tools to apply a controllable therapeutic pressure to whichever portion of the body part is located temporarily within the gap.

The method, in an embodiment, extends to causing relative massaging movement between at least one of the tools and the body part. The step of causing the movement may entail causing at least one of the tools to traverse a surface of the body part opposite to the body part surface receiving massage.

In an embodiment, the method includes applying the first massage tool to support the body part and the second to apply massaging pressure to the supported part.

The method may further include operating the connector means repeatedly during massage, whereby the gap is adjusted to apply a selected degree of pressure to a different part of the body reached as a result of movement of the second tool in relation to the body.

The method may also include the step of providing the connector means in the form of a reinforcing bar connector for connecting reinforcing bar elements of the first and second subassemblies, wherein rotation of the connector causes adjustment of the length of the frame sides by adjusting the spacing between the subassemblies.

Operating the connector means to adjust the gap may include releasing a locking mechanism that prevents uncontrolled increasing of the gap.

In an embodiment, the locking means includes a ratchet.

BRIEF DESCRIPTION OF THE DRAWINGS

In order that the disclosure may be readily understood, and put into practical effect, reference will now be made to the accompanying figures. Thus.

In the drawings, like parts are denoted by like numbers according to context throughout.

DETAILED DESCRIPTION

Figure 1:
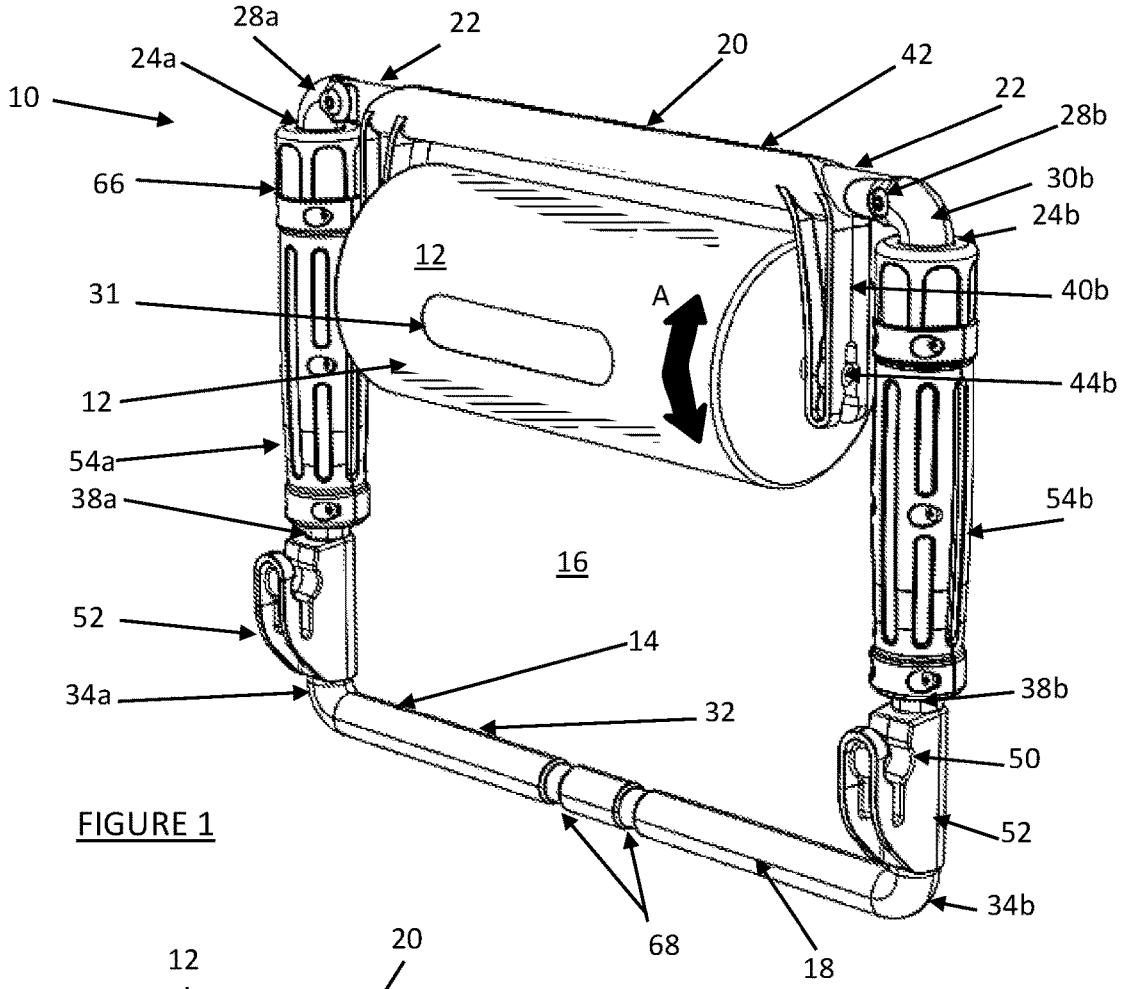
FIG. 1 shows in front perspective view, one embodiment of the apparatus, but with only one of the massage tools fitted.

Referring to FIG. 1, in one embodiment, the massage apparatus is generally denoted by the number 10 and shown in perspective view with only one tool 12 of two massage tools operatively mounted. The apparatus has a generally rectangular frame 14 surrounding an opening 16. Frame 14 is made up of two main detachable and reconnectable subassemblies, 18 and 20. For ease of reference below, subassembly 18 will be referred to as the lower frame portion and subassembly 20 as the upper subassembly or frame portion. Each subassembly includes a pair of reinforcing bars ('rebars'), each connected to an opposite end of a crossbar. Connection may be fixed, not permitting relative movement between connected elements, or permissive of relative movement, such as by pivotal links, including hinges.

In the description that follows, the terms 'upper' and 'lower' are used for convenience to distinguish between features of the apparatus as depicted in the drawings. They are not intended to limit the use and application of the apparatus to the shown orientations.

In the case of upper subassembly 20, crossbar 22 is pivotally connected to its rebars 24*a*, 24*b* by bolts 28*a*, 28*b* passing through elbows 30*a*, 30*b*. The pivotal connection allows the angle subtended between each rebar and the crossbar to be adjusted.

The lower subassembly 18 includes a crossbar 32 and elbows 34*a*, 34*b* connecting it at fixed right angles to upwardly extending rebars 38*a*, 38*b*.

The rebars are provided in the form of lengths of circular metal bars having a spiral groove thread, as will be elaborated on below. It will be appreciated that instead of bars, tubing of metal or of other materials of comparable stiffness and yield strength may be used. The bars may have a brushed aluminium, stainless steel or similar finish suitable for the intended service.

When a second massage tool 36 (shown in FIG. 2) is operatively mounted to lower subassembly 18, a therapeutic massaging gap 26 is defined in space 16, wherein a portion of a massage receiver's body to be massaged (not shown) is receivable. The body portion may be a limb or torso, abdomen or even the head and neck, and is rendered receivable by adjusting the width of the gap as discussed below.

Massage tool 12 is rotatably suspended below a top frame element 28, by means of a pair of screw-threaded locating shafts 20, which pass through suspending brackets 40*a*, 40*b*, which extend from a mounting sleeve 42 secured about the crossbar. Rotation directions are denoted by directional arrow A in FIG. 1. Sleeve 42 is fitted to surround crossbar 22.

Massage tool 12 has a shallow recess 31 in its round cylindrical surface, to provide space for branding or the like. Other than having this feature, the tool has a constant round cylindrical surface, which serves for it to act as a supporting brace or stabilizer when the second tool 36, selected to provide a planned therapeutic benefit, is brought to bear on the side of the patient's limb requiring therapy. It is the second tool that may include discontinuities such as recesses, protrusions, bulges and saddles according to therapeutic designs, as will be discussed in further paragraphs below. Its surface may be imbued with selected properties of varying effect when pressed against or rolled along the skin of a massage recipient.

The massage tool of FIG. 1, as shown in the shape of a roller in this embodiment, is made from solid rubber. It will be appreciated that the tool may be provided in a broad range of materials, upholstery and surface textures within the scope of this disclosure. In another embodiment, it may be made from self-skinning foam.

Figure 2:
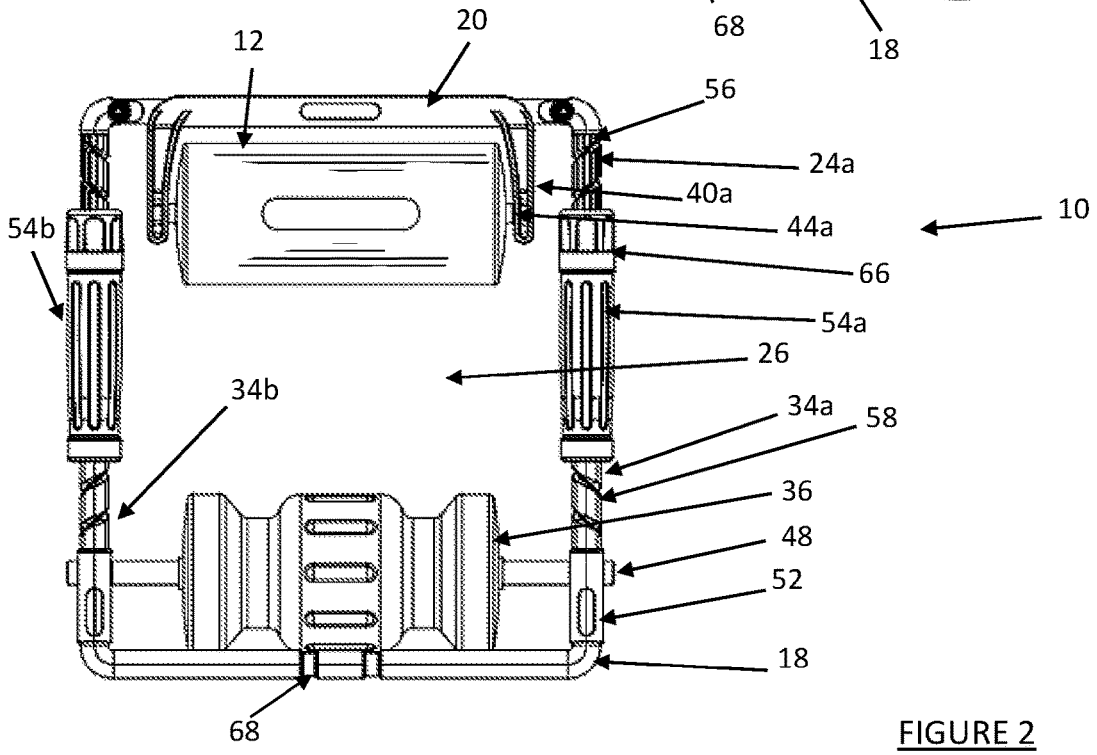
FIG. 2 is a rear view of the apparatus of FIG. 1 with a second tool operatively mounted.

FIG. 2 shows the second massaging tool 36, here in the form of a rotatable resilient roller of varying diameter along its length, operatively mounted to subassembly 18 on an axle 48, which is clamped to rest within expanding sockets 50, located in receiving brackets 52, which in turn are secured to opposing side rebars 34*a*, 34*b* of lower subassembly 18. Tool 36 is used for performing a primary therapeutic function and will have a shape and surface texture intended in the massage art for producing a predetermined therapeutic effect, or to activate a trigger point or provide other sensory stimulation. The tool is made of a polymeric foam, rubber or similar materials having a therapeutically suitable density and resilience, its composition not being essential to the disclosure.

The therapeutic second tool may be provided in any suitable overall general shape, such as a truncated cone, or a cylinder of non-circular profile, for example elliptical, oval, triangular, rectangular or hexagonal and the like.

Figure 3:
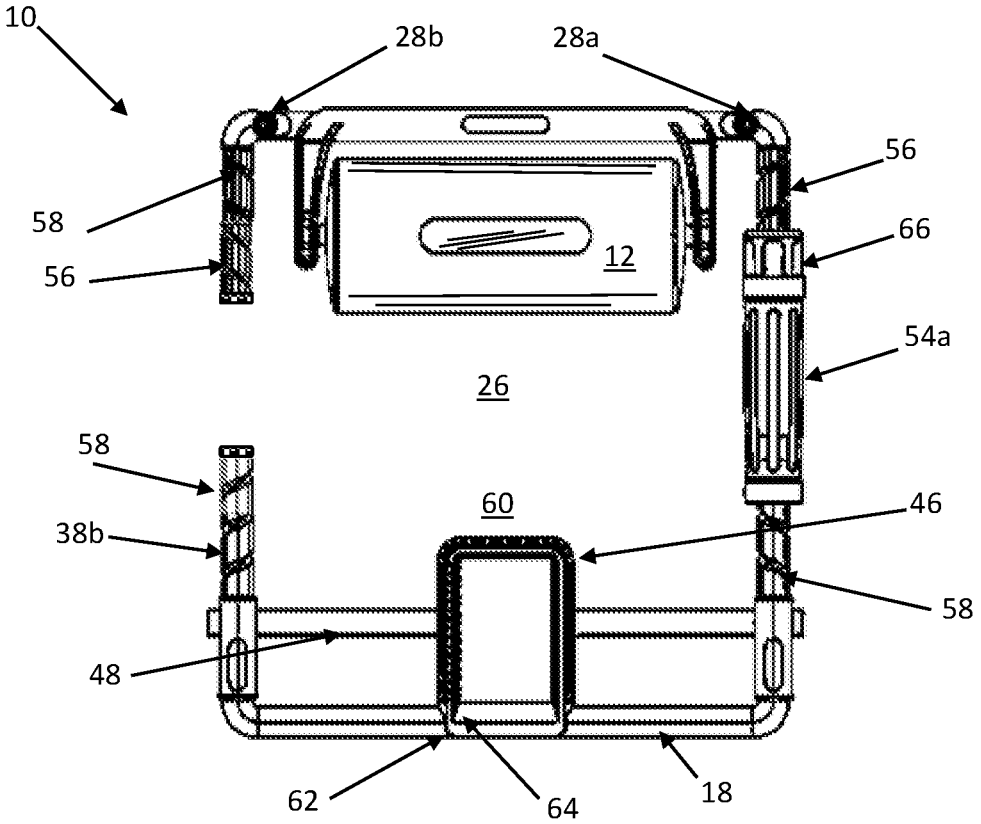
FIG. 3 is a rear view of the apparatus of FIG. 1 with an alternative second tool operatively mounted and with one of the hand grips removed.
Figure 4:
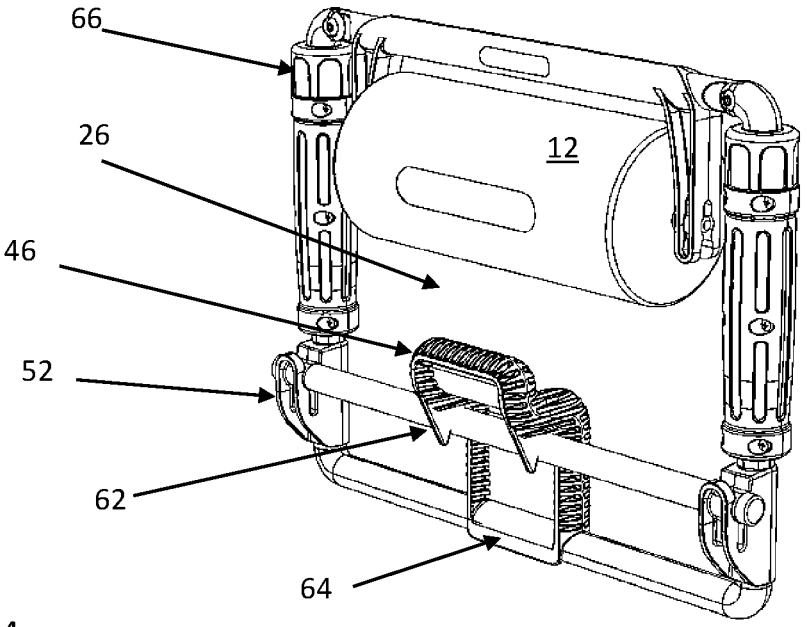
FIG. 4 is a front perspective view of the apparatus of FIG. 3 with both hand grips in position.
Figure 5:
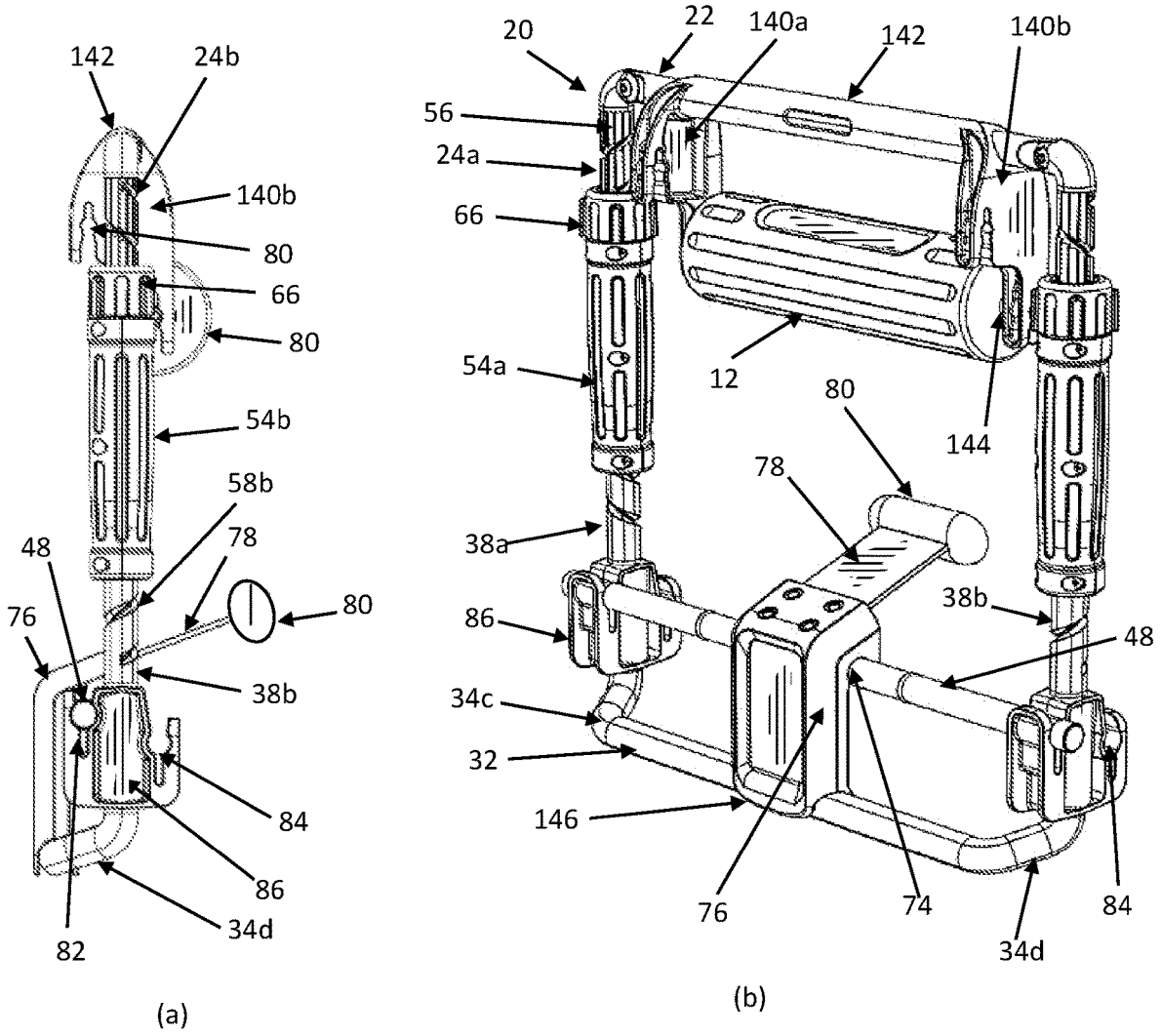
FIG. 5 is a side view and front perspective view of the apparatus according to a further embodiment.

Applying tools of different shapes to the person of the receiver provides different therapeutic effects in use. The receiver may withdraw the body portion being massaged, invert the apparatus and then re-insert the portion to apply massage using thus the previously opposite tool to vary the massage effect or stimulation achieved. The tools shown and numbered 12 and 36 should not be construed as limiting of the scope of this disclosure Alternative tools are illustrated in FIGS. 3, 4 and 5.

The axis of roller 36 is not located in the plane of the frame, but is slightly offset from it. This can provide an angular advantage in certain massage routines. For example, when both tools are in the form of rollers and are applied to the front and back of a receiver's thigh to treat a hamstring ailment, the offset can be used to advantage to apply the therapeutic tool 36 to the full extent along the back of the patient's thigh to the origin of the hamstring, while the supporting roller of tool 12 can only traverse from the knee to the lower part of the groin on the patient's front.

Detachably connecting rebars 24*a* to 34*a* and 24*b* to 38*b* is a pair of rebar connectors externally shaped as hand grips 54*a*, 54*b*. These are located adjacent to massage gap 26 and axially orthogonal to lower crossbar 18. The hand grips may be of a rubberised or polymeric material as is known for use on therapeutic or exercise-related apparatus. Within each hand grip is a hollow tube having oppositely directed internal threaded surface portions for receiving the oppositely threaded free ends of rebars 24*a* and 38*a*, and 24*b* and 38*b*. The rebars 24*a*, 24*b* of the upper subassembly have axially parallel ratcheting grooves and ridges 56, rendering them engageable with connector 54*a*, 54*b* according to known mechanisms. The ratchet mechanism allows the user to rotate the handgrip about its axis and elevate it towards the upper crossbar, without relinquishing the position progressively attained relative to the rebar about which it is twisting. To disengage the ratchet lock, portion 66 of the handle connector 54*a*, 54*b* is rotated counter to the rotational direction that caused the connector to lock, as the case requires.

The action of rotating the connectors, individually or together, causes the sides of the frame between opposing crossbars 32, 22 to be lengthened or shortened selectively and individually at the operator's discretion, depending on the direction of rotation. Relative axial displacement of the rebars is accomplished from a configuration of minimum displacement and hence minimum frame side length, to one of maximum extension until separation of the upper and lower rebar portions is achieved.

When putting the apparatus to clinical use, the operator places the frame so that it encompasses the limb to receive massage therapy and ensures the upper and lower subassemblies are operatively connected. The operator then rotates connector portions 54*a*, 54*b* along their respectively connected rebar portions in the direction required to cause gap 26 to close, so that the massage tools press against the limb from opposite sides. When the operator causes the tools to move along the limb, they will reach thicker or thinner portions, where resistance to further travel will increase or pressure will reduce and contact with the limb may be lost. To avoid these outcomes, the operator rotates connector handle portions 54*a*, 54*b* in the opposite direction, to release the gripping pressure on the limb and loosen contact, or further in the same direction to narrow the gap and substantially maintain the therapeutic pressure against the limb. When the gap is narrowed, the ratchet mechanism locks the connector against unwanted release. Release is then accomplished by twisting disengagement portion 66. The operator may conveniently rotate the connector portion 54*a*, 54*b* using their palm and fingers, while rotating locking part 66 with their thumb.

By allowing release of the connector on one side of the frame and maintaining the position of the connector by not rotating disengagement portion 66 on the other, a reorientation of the gap can be achieved so that the directions from which the forces are exerted by the tools are not necessarily coaxial.

It will be appreciated that equivalent other means of allowing relative displacement of the tools may be provided without departing from the scope of the present disclosure. For example, a frame may be constructed using a pair of flat bars having bolt holes at corresponding positions and a pair of threaded bracing rods. The frame may be formed by passing the bars through the holes and spacing the bars from each other by securing them to the rods in a desired spacing by means of nuts or other spacers. A pair of massage tools may be fixed to the inner sides of the flat bars to create a massage gap.

FIG. 3 illustrates the apparatus of the disclosure, wherein the left-hand side of the frame is shown extended to the extent that handgrip and connector 54*b* from FIG. 1 has been screwed off and removed completely, to expose the threaded shaft portions 58 of rebars 24*b* and 38*b*.

Removal of the connector opens the frame between the rebars for receiving a portion of the body that may be unable to fit through the frame when the opening is closed, for example an upper limb portion. By also removing the opposite hand grip and connector 54*a*, the entire frame is separable into the two subassemblies 18 and 29 that may then be placed around a massage receiver before being reconnected for operative use. The reader should appreciate too that each of the separated subassemblies may be used individually if appropriate. In such an instance, the masseur may wish to reconnect the handgrips to the subassembly that is intended for use, to provide for optimum control of the tool on the receiver's body.

In an alternative embodiment of the apparatus of this disclosure, crossbar 22 from FIG. 1 is provided in telescopic portions housed with sleeve 42, allowing its length to be adjusted to accommodate differential adjustment of the lengths of the sides to which it is connected. Because of pivotal connections 28*a*, 28*b* and the capacity to lengthen and shorten upper crossbar 22 by virtue of its telescopic nature, differential adjustment of the lengths of the frame sides defined by the rebars is achievable, and the upper and lower crossbars are able to be displaced from parallel axial orientation. This allows the massage tools to be orientated at selectable angles and thereby to apply load to the receiver's body at different therapeutically selectable angles.

A further embodiment is described with reference to FIG. 1, but is not separately illustrated. In this embodiment, elbow 34*a* of lower assembly 14 is replaced with a pivotal connector of the type numbered 28*a*, 28*b* in upper subassembly 20, giving a further degree of freedom to the operative configuration of the apparatus. In this embodiment, upper crossbar 22 may be of fixed or variable length. With the additional pivotal connector fitted, rotating the ratchet connector 54*a*, to increase the length of the frame side it defines together with rebars 24*a* and 38*a*, causes that side to pivot inwardly and crossbar 22 to pivot outwardly and upwardly to compensate. This adjustment will change the position of the gap and the angle at which the massage giving tool is oriented toward the support tool.

In the embodiment being described, an alternative second tool 46 replaces tool 36 shown in FIG. 2. Tool 46 is stationary, relative to frame 14, and is in the form of a moulded bridge 60 mounted to axle 48 and stabilised against rotation and lateral displacement by locking formations in the form of hooks 62 that locate around axle 48 and a cradle 64 that locates over bottom frame side 18 in twin grooves 68.

Tool 46 is designed to have trigger point-accessing solid parts that can be brought to press against relevant zones of the body for relief of symptoms such as stiffness and knots in muscle tissue.

The configuration of the apparatus and the presence of axle 48 displaced from but parallel to lower crossbar 18 enables a variety of massage tools of different shapes and functions to be fitted—either for stationary use for point massage, or for rolling application. Tool 12 may also in other embodiments be substituted by tools of a variety of shapes chosen to complement the primary massage tool (36 or 46) and thereby provide targeted therapies.

Referring to FIG. 5, a further embodiment of the disclosed apparatus is illustrated, in which like parts from the other embodiments carry like numbering. FIG. 5(*a*) is a side elevational view and FIG. 5(*b*) and front perspective view. In this embodiment, the lower cross bar element 32 is connected by doubled elbow connectors 34*c*, 34*d* to the side elements 38*a*, 38*b* respectively, resulting in the longitudinal axis of bar element 32 not sharing the plane of axes of elements 38*a* and 38*b*, nor of the plane of the remainder of frame 14. This configuration is advantageous in enhancedly supporting the therapeutic tool when strong contact is required with the flesh of a limb being massaged.

In this embodiment, a stationary tool 146 is supportively braced against bar 32 to prevent pivotal rotation about axle bar 48, about which it is mounted on recesses 74 in a body portion 76. A sprung plate 78 connects the body portion to a therapeutically rounded cylindrical head portion 80. In this way it presents a therapeutic head portion that is stably mounted to the frame, but has a permissible degree of resilience, by virtue of the sprung plate, when applied to the limb to be massaged.

There are two mounting slots 82, 84 in support bracket 86, for receiving axle bar 48. The mounting slots are located on either side of the plane defined by the side elements 38*a*, 38*b*. Providing dual slots increases the massage options available to a masseur and the range of tools that may be fitted for therapeutic function.

The upper subassembly 20 of the frame has a mounting bracket assembly with side brackets 140*a*, 140*b* supported from upper crossbar 22 by way of cowl 142 which extends along it virtually from end to end. A rubber support tool 12 is mounted on axial shaft stubs 144, extending from either end into receiving slot 92, located at the distal portion of bracket 140*a*, 140*b*. A second slot 94 is located closer to cross bar 22 and cowl 142, but on the opposite side of the plane of side elements 24*a*, 24*b*, to provide an alternative, more distant mounting option for tool 12 via its axle stubs 144 in relation to lower support axle 48. A greater range of tools in respect of shape, size and function can thus be accommodated in operative orientation and in a range of differing orientations and distances, by making use of the frame mounting options.

An advantage of the apparatus of this disclosure is that the tool configuration is such that the user giving the massage is not required to rely on their own force and strength to administer a therapy. It is the tool that applies the selected pressure according to the gap set by the masseur. Once the spacing is set, the gap and the force exerted by the primary tool against the limb being supported by the secondary tool is constant. The masseur's role is then to cause the tool to traverse the limb under treatment while adjusting the gap by rotation and counter-rotation of the connector and its locking portion to maintain the pressure the masseur finds or considers necessary for the therapy. This enables substantial constancy to be achieved throughout a treatment, irrespective of the person providing it. In instances where the body part being massaged changes girth significantly, the gap is able to be adjusted without need for withdrawing the part from the gap.

These embodiments merely illustrate selected examples of the massage method and apparatus of the disclosure. With the insight gained from this disclosure, the person skilled in the art is well placed to discern further embodiments by means of which to put the subject of this disclosure into practice.

The invention claimed is:

1. A massage apparatus comprising:

an openable and closeable rigid frame comprising a pair of opposing crossbar elements connected with a pair of opposing upright elements, wherein the crossbar elements are pivotally connected to the upright elements, wherein:

i. the pair of opposing crossbar elements support opposingly-located first and second massage tools mounted thereon to define between them a massage gap, wherein a body portion is receivable for massaging; and ii. the pair of opposing upright elements extend between the pair of opposing crossbar elements, each upright element comprising:

an upper rebar that extends downward from an upper crossbar element of the pair of opposing crossbar elements to a first threaded free end;

a lower rebar that extends upward from a lower crossbar element of the pair of opposing crossbar elements to a second threaded free end; and a hand grip coupling the upper rebar to the lower rebar, wherein the hand grip includes an internal threaded surface that engages both the first threaded free end of the upper rebar and the second threaded free end of the lower rebar, the hand grip for gripping by a user when applying massage therapy with the apparatus, and wherein the engagement between the first threaded free end and the hand grip and the engagement between the second threaded free end and the hand grip causes the upright element to axially extend or contract, independent of the other upright element, when the user rotates the hand grip while applying massage therapy to the body portion, thereby allowing the user to selectively adjust a size of the massage gap between the first and second massage tools while applying the massage therapy to the body portion;

wherein said massage tools in use exert a force substantially continuously on the massage-receiving body portion received in the massage gap.

2. A massage apparatus according to claim 1, wherein the apparatus is separable into first and second subassemblies, each bearing one of said massage tools.

3. A massage apparatus according to claim 2, wherein one crossbar element of the pair of crossbar elements is part of the first subassembly, and comprises an axially extensible crossbar connected to each upright element.

4. A massage apparatus according to claim 3, wherein the first massage tool is mounted on a shaft connected to be parallel with the axially extensible crossbar.

5. A massage apparatus according to claim 1, wherein the gap and the frame are located in different planes.

6. A massage apparatus comprising:

a. first and second detachably connected subassemblies bearing respective first and second massage tools, the first massage tool being for supporting a body portion to be massaged against the second tool, the second tool being adapted for providing a predetermined massage effect to the massage-receiving human body portion; and b. first and second connectors adapted for gripping by a massage-giving user, each of the first and second connectors including an internal threaded surface that engages both a first threaded free end of the first subassembly and a second threaded free end of the second subassembly, wherein the first and second connectors connect the subassemblies together to define a closed frame that includes a first pair of opposite sides pivotally connected to a second pair of opposite sides, each side of the first pair of opposite sides supporting an associated one of the first and second massage tools, and wherein, for each of the first and second connectors, the engagement between the first threaded free end and the connector and the engagement between the second threaded free end and the connector causes the side of the second pair of opposite sides including the connector to axially extend or contract, independent of the other side of the second pair of opposite sides, when the user rotates the connector while applying massage therapy to the body portion, thereby allowing the user to selectively adjust a size of a massage gap between the first and second massage tools while applying the massage therapy to the body portion.

7. A massage apparatus according to claim 6 wherein the first pair of opposite sides of the closed frame comprises opposed first and second crossbars.

8. A massage apparatus according to claim 7, wherein the first massage tool is rotatably mounted on a shaft spaced from the first crossbar.

9. A massage apparatus according to claim 7, wherein the second massage tool is mounted for being stationary in use, relative to the second crossbar.

10. A method of therapeutic massage comprising the steps of:

a. providing a massage-giving apparatus including:

i. first and second detachably connected subassemblies bearing respective first and second massage tools, each massage tool being capable of imparting a different respective massage effect to a body part of a massage recipient requiring massage;

ii. first and second connectors, each of the first and second connectors including an internal threaded surface configured to engage both a first threaded free end of the first subassembly and a second threaded free end of the second subassembly, the first and second connectors connecting the subassemblies to form a rigid frame that includes first pair of opposite sides pivotally connected to a second pair of opposite sides, each side of the first pair of opposite sides supporting an associated one of the first and second massage tools, wherein, for each of the first and second connectors, the engagement between the first threaded free end and the connector and the engagement between the second threaded free end and the connector causes the side of the second pair of opposite sides including the connector to axially extend or contract, independent of the other side of the second pair, when the massage recipient rotates the connector while applying massage therapy to the body part, thereby allowing the massage recipient to selectively adjust a size of a massage gap between the first and second massage tools while applying the massage therapy to the body portion;

b. operating the first and second connectors to connect the subassemblies together to form said frame, the first and second connectors defining handgrips;

c. causing placement of the body part to be massaged in the massage gap;

d. rotating at least one of the first and second connectors to adjust the massage gap until the first and second massage tools apply a desired therapeutic pressure to the body part and set the massage gap; and e. causing relative massaging movement between at least one of the first and second massage tools and the body part in the massage gap.

11. A massage method according to claim 10 including the step of applying the first massage tool to support the body part and the second massage tool to apply massaging pressure to the supported body part.

12. A massage method according to claim 10, including rotating at least one of the first and second connectors repeatedly to adjust and reset the massage gap, while applying the massage tools to the massage recipient.

13. A massage method according to claim 12, wherein rotating at least one of the first and second connectors includes releasing a locking mechanism that prevents uncontrolled increasing of the massage gap.

* * * * *